US007874545B2

(12) United States Patent
Fumagalli

(10) Patent No.: US 7,874,545 B2
(45) Date of Patent: Jan. 25, 2011

(54) INTRUSION-PREVENTION ENCLOSURE

(75) Inventor: Daniele Fumagalli, Galbiate (IT)

(73) Assignee: Satech Safety Technology S.p.A., Calco (IT)

( * ) Notice: Subject to any disclaimer, the term of this patent is extended or adjusted under 35 U.S.C. 154(b) by 1121 days.

(21) Appl. No.: 11/296,456

(22) Filed: Dec. 8, 2005

(65) Prior Publication Data

US 2006/0150546 A1 Jul. 13, 2006

(30) Foreign Application Priority Data

Dec. 23, 2004 (IT) ..... B02004A0807

(51) Int. Cl.
*E04H 17/00* (2006.01)

(52) U.S. Cl. ..... 256/25; 256/27; 256/65.07; 52/239

(58) Field of Classification Search ..... 256/19, 256/21, 24, 25, 27, 29, 65.02, 65.03, 65.07, 256/65.08, 67, 73, 14, 15; 160/135; 52/239, 52/274, 282.1, 282.4, 282.5, 293.1
See application file for complete search history.

(56) References Cited

U.S. PATENT DOCUMENTS

| | | | | | |
|---|---|---|---|---|---|
| 895,297 | A | * | 8/1908 | Peter | 256/67 |
| 3,428,108 | A | * | 2/1969 | Singer | 160/135 |
| 4,174,096 | A | * | 11/1979 | Campbell | 256/24 |
| 4,625,483 | A | * | 12/1986 | Zacky et al. | 52/239 |
| 4,982,933 | A | * | 1/1991 | Schultz | 256/65.06 |
| 5,779,227 | A | * | 7/1998 | Elkins et al. | 256/24 |

* cited by examiner

*Primary Examiner*—Michael P Ferguson
(74) *Attorney, Agent, or Firm*—Modiano & Associati; Albert Josif; Daniel J. O'Byrne

(57) ABSTRACT

An intrusion-prevention enclosure of the type comprising a plurality of modular panels, that are mutually associatable in an orderly and predefined manner to provide a barrier structure, a plurality of ground support posts provided with detachable upper retention elements for lateral uprights of the panels, and a plurality of lower collars, which are arrangeable at adjustable heights along the posts and are provided with a peripherally distributed plurality of wings, which can engage detachably open lower ends of the uprights. Each wing forms a lateral supporting surface for the base of the open lower end, which allows tilting of the panel in a preset direction, with the retention elements in the configuration for releasing the panels.

4 Claims, 4 Drawing Sheets

INTRUSION-PREVENTION ENCLOSURE

BACKGROUND OF THE INVENTION

Intrusion-prevention enclosures are known which are used to prevent indiscriminate access to specific areas on the part of individuals, animals, vehicles or others; this need usually arises from two basic reasons: preventing uncontrolled access to locations where dangerous or discomfort-causing situations for assigned personnel occur (industrial ovens, presses, more or less rapidly rotating working parts, machines with optical, acoustic, inhalable, deafening emissions), or preventing intruders from removing or damaging products, devices or equipment on sale or in operation (theft, vandalism, unauthorized or dangerous uses).

These intrusion-prevention enclosures are usually constituted by mutually associated modular panels, which are installed on supporting means which can be fixed to the ground; in the particular field, the general trend is to provide enclosures that are easy and quick to assemble.

SUMMARY OF THE INVENTION

The aim of the present invention is to meet the above-mentioned requirements, by providing an intrusion-prevention enclosure in which assembly is simple and requires short execution times.

Within this aim, an object of the present invention is to provide an enclosure that is simple, relatively easy to provide in practice, safe in use, effective in operation, and has a relatively low cost.

This aim and this and other objects that will become better apparent hereinafter are achieved by an intrusion-prevention enclosure of the type comprising a plurality of modular panels, which can be mutually associated in an orderly and predefined manner so as to provide a barrier structure, characterized in that it comprises a plurality of ground support posts provided with detachable upper retention means for lateral uprights of said panels, and a plurality of lower collars, which can be arranged at adjustable heights along said posts and are provided with a peripherally distributed plurality of wings, which can engage detachably open lower ends of said uprights, each one of said wings forming a lateral supporting surface for the base of said open lower end, which is adapted to allow the tilting of said panel in a preset direction, with said retention means in the configuration for releasing said panels.

BRIEF DESCRIPTION OF THE DRAWINGS

Further characteristics and advantages of the invention will become better apparent from the following detailed description of a preferred but not exclusive embodiment of an intrusion-prevention enclosure according to the invention, illustrated by way of non-limiting example in the accompanying drawings, wherein.

DESCRIPTION OF THE PREFERRED EMBODIMENTS

Figure 1:
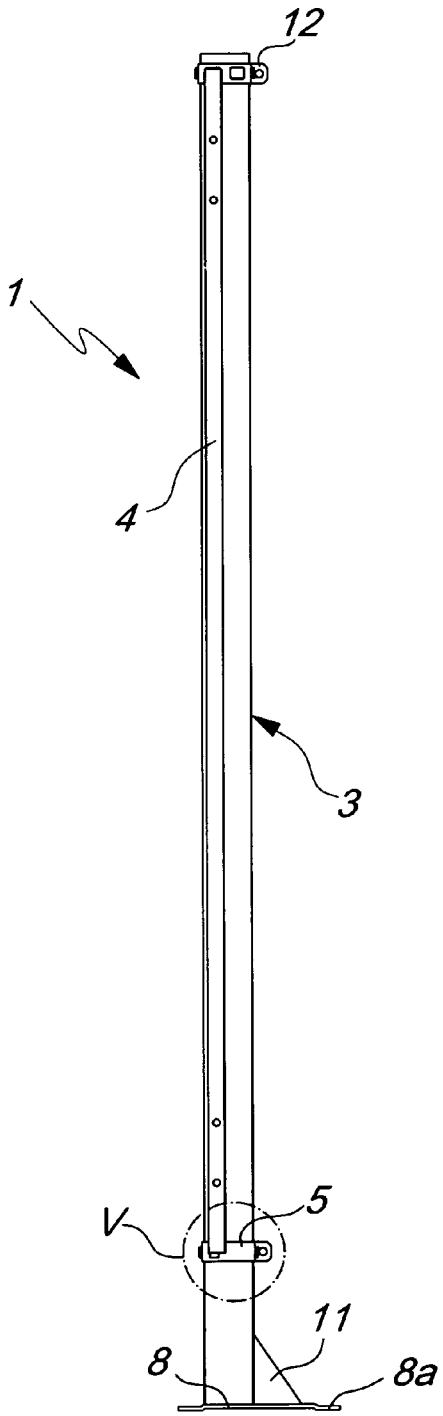
FIG. 1 is a side elevation view of a post associated with a panel in the locked configuration.

With reference to the figures, the reference numeral 1 generally designates an intrusion-prevention enclosure, which comprises a plurality of modular panels 2, a plurality of posts 3 provided with detachable upper retention means for lateral uprights 4 of the panels 2, and a plurality of lower collars 5 for the rapid assembly of the panels 2 to the posts 3 in a predefined orderly manner, so as to provide a barrier structure which is arranged conveniently according to the requirements.

The panels 2 are provided with a preferably rectangular opening C made of a material such as for example metallic mesh with wires that are electrically welded at the nodes and along the perimeter; said opening is delimited by metallic profiles having a tubular cross-section, which comprise an upper cross-member 2*a* and a lower cross-member 2*b*, which are butt-welded, along their sides, against the sides of the two lateral uprights 4 of the panel 2, so that the two uprights 4 have open upper ends 6 and open lower ends 7. The panels 2 can have even substantial dimensions, and in a provided embodiment they have horizontal wires that are more widely spaced than the vertical wires.

Each one of the posts 3 comprises a ground support base 8, which is rectangular and provided with drawn corners 8*a* affected by respective slots 9 for the optional fixing of the post 3 to the ground by means of nails, screws or the like. Positively, the drawn corners 8*a* allow optimum adaptation of the base 8 to the ground, which is often not flat but uneven.

In an upper region, the base 8 has a long vertical leg 10 welded thereto, said leg having a substantially square transverse cross-section; advantageously, the post comprises a substantially triangular reinforcement rib 11, which is welded at right angles between the lower portion of the leg 10 and a central region of the base 8.

A plurality of lower collars 5 and said detachable upper retention means for the quick locking of the panels 2 can be associated, at adjustable heights, with the legs 10 of the posts 3.

Such upper retention means comprise a plurality of upper rings 12, which can be arranged at adjustable heights along the posts 3; positively, a lower collar 5 and an upper ring 12 are associated with each post 3.

Each upper ring 12 is constituted by a lamina, which is folded so as to form a substantially square profile which is complementary to the transverse cross-section of the leg and comprises two facing folded end portions 13.

Each one of the end portions 13 is affected by a respective hole 14 for the insertion of means for the stable and detachable fastening of the ring 12 at a preset height along the leg 10; said fastening means, not shown in the figures, can be for example of the screw type.

Conveniently, each ring 12 comprises a plurality of lugs 15, which are distributed peripherally and can be inserted detachably in the open upper ends 6 of the uprights 4 of the panels 3, for the detachable stable locking thereof to the posts 3 synergistically with the lower collars 5. The lugs 15 have a substantially L-shaped cross-section, with one side associated with the ring 15 and the other side free for insertion in the open upper ends 6 of the uprights 4; the upper rings 15 are fitted to the legs 10 so that the lugs 15 are directed downward.

Each lower collar 5 is constituted by a lamina, which is folded so as to form a substantially square profile, which is complementary to the transverse cross-section of the leg 10 and comprises two facing folded end portions 16.

Each one of the end portions 16 is affected by or is provided with a respective opening 17 for the insertion of means for the stable and detachable fastening of the collar 5 at a preset height along the leg 10; said fastening means, not shown in the figures, can be for example of the screw type.

Conveniently, each collar 5 comprises a plurality of wings 18, which are distributed peripherally and can be inserted detachably in the open lower ends 7 of the uprights 4 of the panels 2 for the detachable stable locking thereof to the posts 3, synergistically with respect to the upper rings 12. Each one of the wings 18 has a substantially L-shaped cross-section, with a first side associated with the collar 5 and a second side free for insertion in the open lower ends 7 of the uprights 4; the lower collars 5 are fitted onto the legs 10 so that the wings 18 are directed upward, and each one comprises at least one wing 18 on each one of its sides.

Figure 2:
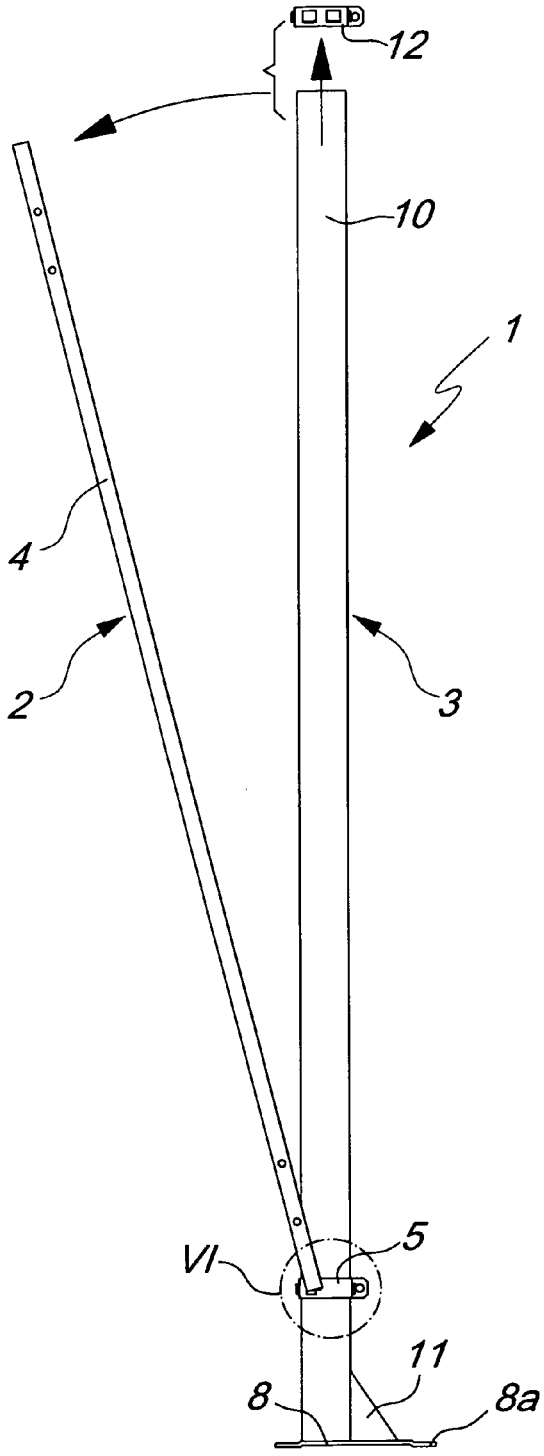
FIG. 2 is a side elevation view of a post associated with a panel during tilting.
Figure 3:
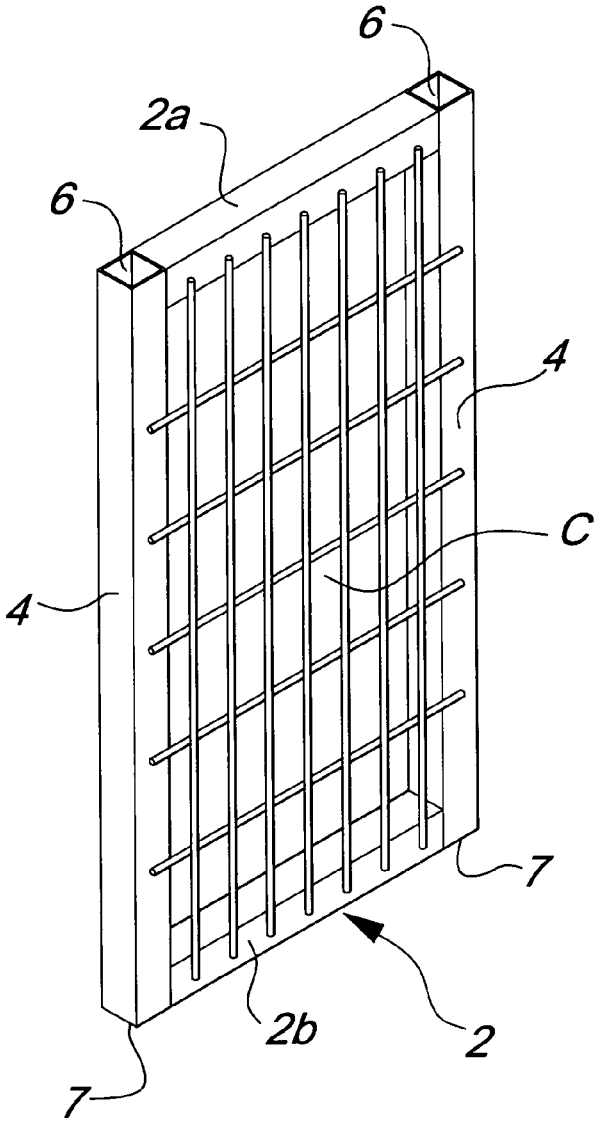
FIG. 3 is a perspective view of a panel of an intrusion-prevention enclosure.
Figure 4:
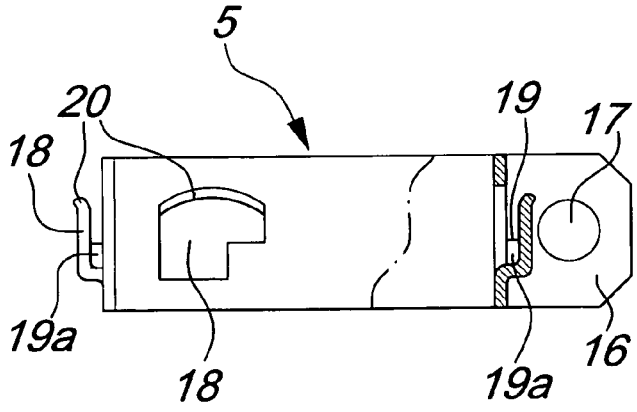
FIG. 4 is a partially sectional side elevation view of a lower collar.
Figure 5:
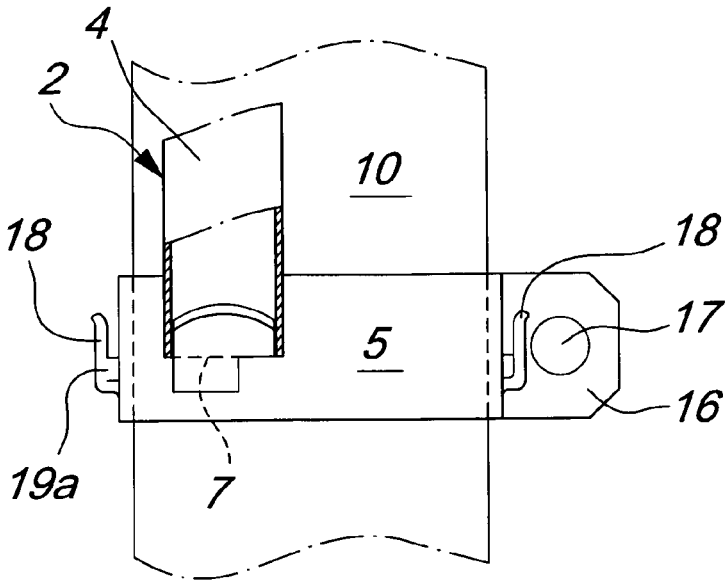
FIG. 5 is a side elevation view of the detail V of FIG. 1.
Figure 6:
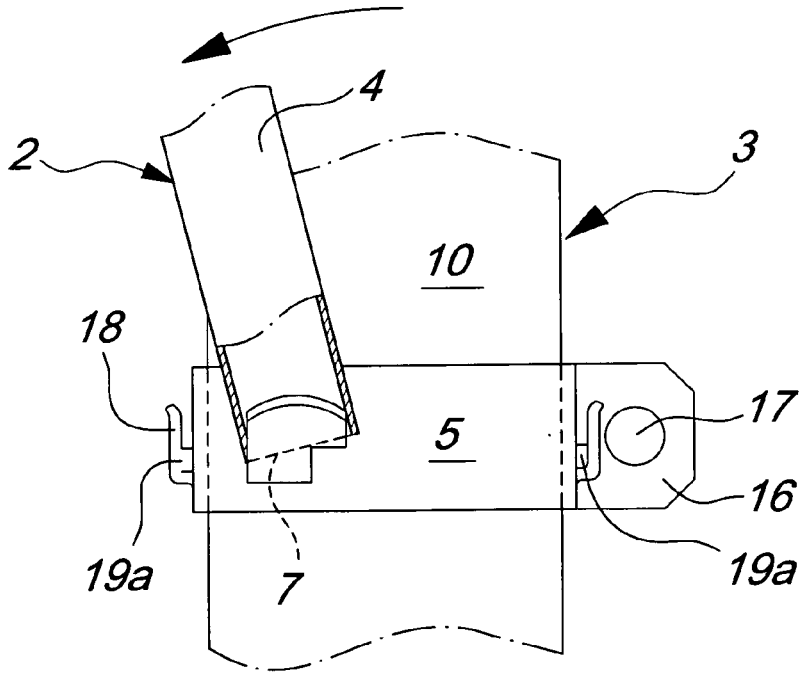
FIG. 6 is a side elevation view of the detail VI of FIG. 2.
Figure 7:
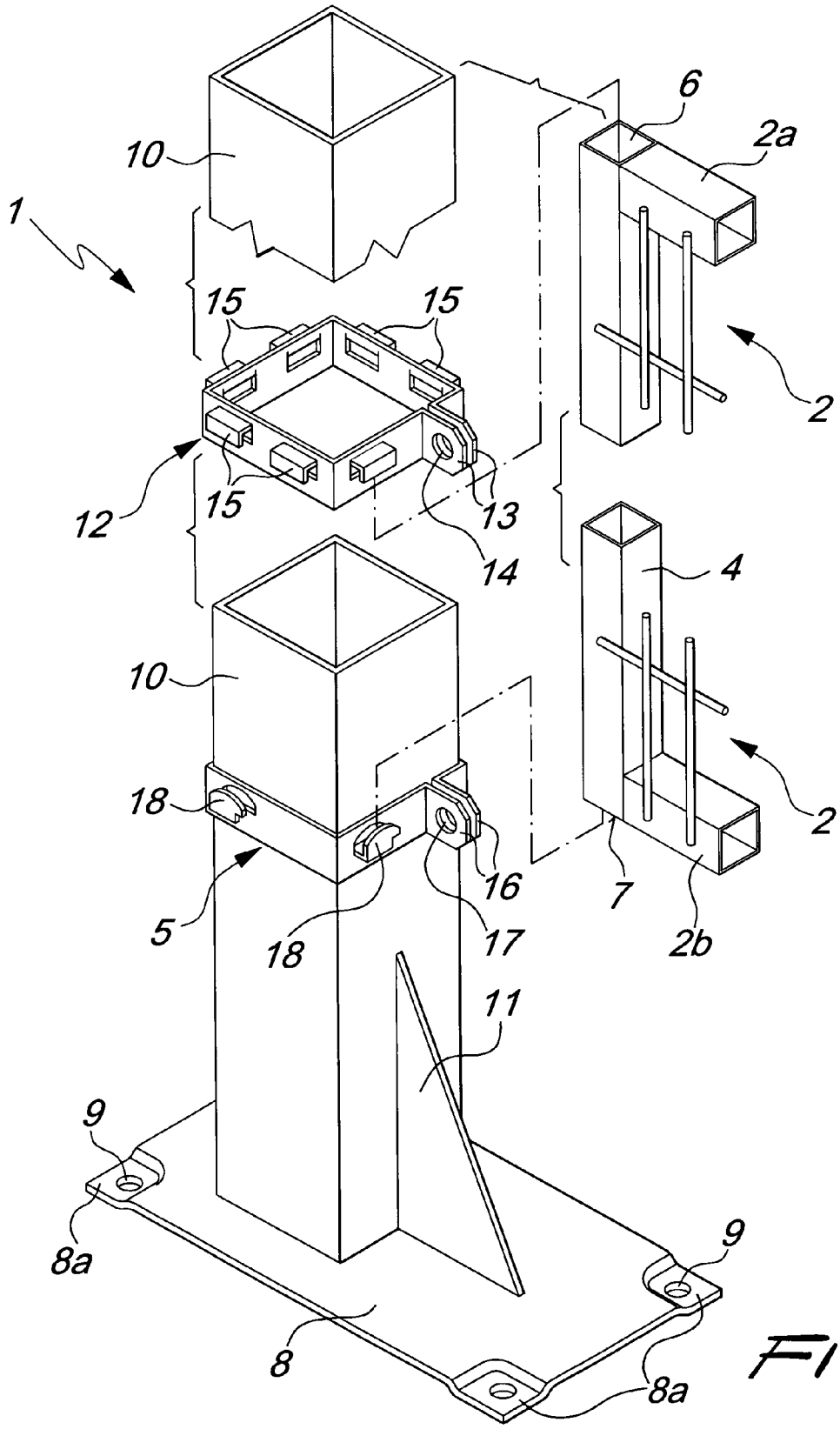
FIG. 7 is a partially cutout exploded perspective view of a detail of an intrusion-prevention enclosure according to the invention.

Advantageously, each one of the wings 18 of the lower collar 5 comprises a lateral supporting surface 19 for the open lower end 7 of the upright 4, in order to allow the tilting of the panel 2 in a preset direction when the upper ring 12 is removed; in particular, the supporting surface 19 provides support only for a lateral portion of the base of the lower end 7 of the upright 4. The supporting surface 19 is preferably formed by a lower portion 19*a* of a side wall of the free side of the L-shape, which is folded inward so as to constitute a sort of lateral step, so that the panel 2, when its center of gravity falls outside the supporting surface 19 formed by said step, is in a position of unstable equilibrium and therefore, when it is not retained upward by the upper ring 12, tilts by rotating in the preset direction determined by the arrangement of the supporting surface 19 (as shown in FIGS. 2 and 6).

Conveniently, the wing 18 forms an upper edge 20, which is substantially arc-like, in order to prevent the accidental stopping of the panel 2 during tilting in the preset direction against protruding or sharp portions.

In practical operation, the open lower end 7 of an upright 4 of a panel 2 is fitted on a wing 18 of the lower collar 5, which is fastened at the selected height along the leg 10; in an upper region, the upper ring 12 is made to slide downward along the leg 10, in a locking configuration, so as to insert a lug 15 thereof in the open upper end 6 of the upright 4 and is then fastened to the post 3 in order to detachably lock the panel 2. Each panel 2 is locked detachably between two posts 3 by two lower collars 5 and two upper rings 12; a plurality of panels 2 can be associated with each post 3. Positively, it is sufficient to extract from the open upper ends 6 of a panel 2 the corresponding upper rings 12, that is so placed in a releasing configuration, in order to cause tilting of the panel in the direction preselected by the arrangement of the supporting surface 19.

In practice it has been found that the invention fully achieves the intended aim and objects, since the intrusion-prevention enclosure 1, advantageously constituted by a small number of components which can be assembled appropriately, is quick and easy to assemble, with evident gains in economic terms and in terms of installation times. Advantageously, the wings 18 of the lower collars 5, provided with the supporting surface 19, allow the tilting of the panels 2 in a preset direction.

The invention thus conceived is susceptible of numerous modifications and variations, all of which are within the scope of the appended claims; all the details may further be replaced with other technically equivalent ones.

In the examples of embodiment described, individual characteristics, given in relation to specific examples, may actually be interchanged with other different characteristics that exist in other examples of embodiment.

Moreover, it is noted that anything found to be already known during the patenting process is understood not to be claimed and to be the subject of a disclaimer.

The embodiment of the present invention shall be carried out in the most scrupulous compliance with the statutory and regulatory provisions related to the products of the invention or correlated thereto and following any required authorization of the corresponding competent authorities, with particular reference to regulations related to safety, environmental pollution and health.

In practice, the materials used, as well as the shapes and the dimensions, may be any according to requirements and to the state of the art without thereby abandoning the scope of the protection of the appended claims.

The disclosures in Italian Patent Application No. BO2004A000807 from which this application claims priority are incorporated herein by reference.

What is claimed is:

1. An intrusion-prevention enclosure comprising: a plurality of modular panels with respective lateral uprights, and which are mutually associatablo to provide a barrier structure; a plurality of ground support posts;

detachable upper retention means provided at said support posts for retention of said lateral uprights of said panels; a plurality of lower collars, which are arrangeable at adjustable heights along said posts; a plurality of wings peripherally distributed on said lower collars, and which are detachably engageable with open lower ends of said uprights; each one of said wings forming a respective lateral supporting surface for receiving a respective one of said open lower ends, each respective open lower end resting on said lateral supporting surface of one of said wings and being allowed to rotate by pivoting around said lateral supporting surface so as to obtain a tilting of said panels in a preset direction, when said retention means is detached so as to be placed in a configuration for releasing said panels, and wherein each one of said wings has a substantially L-shaped cross-section, with a first side attached to said collar and a second side free for insertion in an open lower end of said uprights, said supporting surface being formed by a lower portion of a side wall of the second free side of the L-shaped wing, said lower portion being folded inward toward said collar so as to constitute a lateral step, whereby to allow said panel having its center of gravity outside said supporting surface and being in a position of unstable equilibrium, and not retained in an upper region thereof by said retention means to tilt by rotating in a preselected direction.

2. The enclosure of claim 1, wherein each said wing has an upper edge which is substantially arc-shaped and is adapted to prevent an accidental stopping of the panel during tilting in the preselected direction, said arc-shaped upper edge preventing said panel from catching against sharp edges of the wing, said wing being provided with an edge, opposite to the arc-shaped edge, that is step-shaped.

3. The enclosure of claim 1, wherein said retention means comprise a plurality of upper rings, which are arrangeable at adjustable heights along said posts and have a plurality of peripherally distributed lugs, which are detachably engageable with open upper ends of said uprights.

4. The enclosure of claim 3, wherein said panels have a substantially rectangular opening with a perimeter that is delimited by an upper cross-member and a lower cross-member thereof, which are associated with side wails of said uprights that comprise said open upper ends and said open lower ends.

* * * * *